US010065789B2

(12) United States Patent
Lamboy et al.

(10) Patent No.: US 10,065,789 B2
(45) Date of Patent: Sep. 4, 2018

(54) ACTUATION UNIT FOR A PLURALITY OF AEROSOL CANS AND USE ON AN ACTUATION UNIT

(71) Applicant: KAO GERMANY GMBH, Darmstadt (DE)

(72) Inventors: Peter Lamboy, Darmstadt (DE); Shuhei Matsumoto, Darmstadt (DE)

(73) Assignee: KAO GERMANY GMBH, Darmstadt (DE)

( * ) Notice: Subject to any disclaimer, the term of this patent is extended or adjusted under 35 U.S.C. 154(b) by 2 days.

(21) Appl. No.: 15/257,165

(22) Filed: Sep. 6, 2016

(65) Prior Publication Data

US 2017/0166389 A1 Jun. 15, 2017

(30) Foreign Application Priority Data

Dec. 11, 2015 (EP) ..... 15199580

(51) Int. Cl.

| | |
|---|---|
| ***B67D 7/06*** | (2010.01) |
| ***B65D 83/20*** | (2006.01) |
| ***B65D 83/48*** | (2006.01) |
| ***B65D 83/68*** | (2006.01) |

(52) U.S. Cl.

CPC ..... *B65D 83/205* (2013.01); *B65D 83/48* (2013.01); *B65D 83/68* (2013.01)

(58) Field of Classification Search

CPC ..... B65D 83/205; B65D 83/48; B65D 83/68; B65D 47/06

USPC ..... 222/135, 137, 144.5, 545, 134, 402.13

See application file for complete search history.

(56) References Cited

U.S. PATENT DOCUMENTS

| | | | | |
|---|---|---|---|---|
| 3,236,418 A * | 2/1966 | Dalle | ..... | B65D 83/682 222/131 |
| 3,303,970 A * | 2/1967 | Breslau | ..... | B65D 83/202 137/607 |
| 3,635,372 A * | 1/1972 | Van Dyck | ..... | B65D 83/60 222/135 |
| 4,773,562 A * | 9/1988 | Gueret | ..... | A45D 40/24 222/135 |

(Continued)

FOREIGN PATENT DOCUMENTS

JP 2004123106 A * 4/2004

OTHER PUBLICATIONS

JP2004123106 with Machine Translation.*

*Primary Examiner* — Vishal Pancholi
(74) *Attorney, Agent, or Firm* — Norris McLaughlin & Marcus P.A.

(57) ABSTRACT

Actuation unit for plural aerosol cans has a cover, a first button partially guided by the cover for pushing a first aerosol vent of a first aerosol can, a second button partially guided by the cover for pushing a second aerosol vent of a second aerosol can, wherein the first button and the second button are adjacent to each other, and a connection unit connected to the cover, the connection unit comprising a first upper clip for clamping a head part of the first aerosol can, a second upper clip for clamping a head part of the second aerosol can, a first lower clip for clamping a body part of the first aerosol can and a second lower clip for clamping a body part of the second aerosol can, the connection unit adapted for covering only an upper part of the first aerosol can and the second aerosol can.

16 Claims, 3 Drawing Sheets

(56) References Cited

U.S. PATENT DOCUMENTS

| | | | | |
|---|---|---|---|---|
| 5,169,029 | A * | 12/1992 | Behar | B05B 11/3084 128/200.23 |
| 6,834,778 | B2 * | 12/2004 | Jinbo | B65D 83/285 132/112 |
| 7,195,135 | B1 * | 3/2007 | Garcia | B05B 11/3084 222/137 |
| 7,854,350 | B2 * | 12/2010 | Lasserre | B65D 83/68 222/135 |
| 2007/0034653 | A1 * | 2/2007 | Strand | B65D 83/206 222/402.13 |
| 2007/0045343 | A1 * | 3/2007 | Lasserre | B65D 83/20 222/135 |
| 2007/0108231 | A1 * | 5/2007 | Gray | B01F 5/0603 222/135 |
| 2013/0175297 | A1 * | 7/2013 | Sugimoto | B65D 83/206 222/135 |

* cited by examiner

ACTUATION UNIT FOR A PLURALITY OF AEROSOL CANS AND USE ON AN ACTUATION UNIT

BACKGROUND OF THE INVENTION

The invention relates to an actuation unit and a use of an actuation unit, by means of which a plurality of aerosol cans can be actuated separately or altogether.

Some cosmetic haircare products require mixing of two or more components before use, wherein these components are provided as aerosol in aerosol cans. A hair dresser wants to adjust the dispensing amount of each component in order to adjust the result, such as color, hardness, surface gloss, straightness, stickiness, lastingness and the like. For that reason there is a need for facilitating the mixing of different aerosols.

From JP 2002-059981 A an actuation unit for actuating two liquid dispenser is known. The actuation unit is clamped to the head parts of the two liquid dispenser an provides a first button for dispensing the first liquid dispenser, a second button for dispensing the second liquid dispenser and a third button for dispensing both the first liquid dispenser and the second liquid dispenser via the first button and the second button. The liquid dispenser are placed on a table or the like, when a button is pressed. However, this actuation unit is not suitable for discharging aerosol cans. Due to the inner pressure of the aerosol can a higher force is necessary for open an aerosol vent compared to a liquid dispenser pump. In addition, aerosol cans, particularly in a haircare application, are usually used in the hand of an operator but not placed on a table. When this actuation unit would be used for aerosol cans, the aerosol can would be tilt during use and/or pressed out of the actuation unit in reaction to a pressed button.

In order to overcome this problem JP 2004-123106 A discloses an actuation unit for actuating two aerosol cans, wherein the actuation unit is fixed to a container by which the two aerosol cans are received. The container provides a sidewall, which prevents a tilting of the aerosol cans, and a bottom for keeping the aerosol cans in the actuation unit, when a force is applied to the aerosol vents via a corresponding button. However, it is at least inconvenient to replace an aerosol can, if possible at all. Further, the operator cannot see which aerosol cans are provided in the actuation unit, so that there is a high risk that a wrong component is applied.

SUMMARY OF THE INVENTION

It is an object of the invention providing measures enabling a facilitated application of a plurality of aerosols at the same time and individually, particularly for applying cosmetic products like haircare products.

An aspect of the invention is directed to an actuation unit for a plurality of aerosol cans, comprising a cover, a first button for pushing a first aerosol vent of a first aerosol can, wherein the first button is partially guided by the cover, a second button for pushing a second aerosol vent of a second aerosol can, wherein the second button is partially guided by the cover, wherein the first button and the second button are arranged adjacent to each other, particularly partially guided by each other, and a connection unit for clamping the first aerosol can and the second aerosol can connected to the cover, wherein the connection unit comprises a first upper clip for clamping a head part of the first aerosol can, a second upper clip for clamping a head part of the second aerosol can, a first lower clip for clamping a body part of the first aerosol can and a second lower clip for clamping a body part of the second aerosol can, wherein the connection unit is adapted for covering only an upper part of the first aerosol can and the second aerosol can.

It is possible actuating only the first aerosol can by pressing the first button and actuating only the second aerosol can by pressing the second button by means of a human finger. Since the buttons are arranged adjacent to each other, it is in addition possible actuating the first aerosol can and the second aerosol can altogether by pressing the first button and the second button at the same time by means of the same human finger. An operator may vary the provided amount of the content of the aerosol cans easily by slightly changing the position of his finger on the buttons. Since the first button and the second button are guided by the cover and preferably by each others a tilting and/or blocking of the buttons when pressed is prevented even when the actuation force of the human finger is applied not centrally but shifted to the rim of the button. Particularly preferred the number of buttons corresponds to the number aerosol cans, which can be received by the connection unit, particularly two. An additional button for actuating two aerosol cans altogether can be omitted.

Since the connection unit only covers a part of the aerosol cans the aerosol cans may protrude from the whole actuation unit with their lower part. The actuation unit may be adapted for covering only an upper part of the first aerosol can and the second aerosol can. When the aerosol cans are inserted into the connection unit, the aerosol cans stay accessible for easily replacing one aerosol can by another. Since particularly a majority of the aerosol cans is not covered, the operator may easily read information provided on the aerosol can. The risk that the operator uses a wrong aerosol can in the actuation unit is significantly reduced or even eliminated. This facilitates the use of the actuation unit for a plurality of different aerosol cans so that a high variety for applying a plurality of aerosols is given, wherein a convenient exchange of the aerosol cans is provided at the same time.

Due to the upper clip and lower clip the respective aerosol can be clamped on two different places spaced to each other in longitudinal direction. Thereby, a tilting of the aerosol can during use can be prevented. Particularly the operator may grab an aerosol spray system consisting of the actuation unit and the aerosol cans inserted into the actuation unit at the aerosol can without the risk of tilting the aerosol can or detaching the aerosol can by tilting. Further, the aerosol can cannot be tilted when an actuation force is applied to the aerosol vent of the aerosol can via the corresponding button. Since the aerosol can is not clamped by only one clip but by at least two clips the clamping force can be significantly increased, particularly mainly doubled. Due to the increased clamping force and the provided friction force the aerosol can can be kept in the connection unit even when the actuation force is applied for opening the aerosol vent.

The guided and adjacently arranged buttons allows the actuation of two or more aerosol cans altogether and individually without an additional button, wherein the two clips of each aerosol can prevents a tilting or detaching of the aerosol can, when the button applies a sufficient actuation force for opening the aerosol vent of the respective aerosol can. Due to the guidance of the buttons only the amount of the force applied to the respective button directed in the actuation direction is applied to the aerosol vent. The amount of the applied force directed lateral to the actuation direction is supported by the cover and/or the other button.

This may mean that for opening an aerosol valve of the push valve type only the amount of the applied force directed in longitudinal direction of the aerosol can is the actuation force applied to the aerosol vent of the aerosol can. This means that only this part of the applied force arrives at the aerosol can that is sufficient for opening the aerosol valve. A too high actuation force applied to the aerosol can is prevented so that the two spaced clips for clamping the aerosol can are sufficient to prevent a tilting and detaching of the aerosol can. Due to the guidance of the buttons the upper clip and the lower clip are sufficient for preventing a tilting and detaching of the protruding aerosol cans, so that a facilitated application of a plurality of aerosols at the same time and individually, particularly for applying cosmetic products like haircare products, is enabled.

The upper clip and the lower clip may be designed similar to a clip connector. Particularly a plurality of upper clips and/or lower clips are arranged in circumferential direction of the respective aerosol can one after another. The respective clip may protrude in lateral direction mainly parallel to the aerosol can and may be elastically bend away in a lateral direction by the material of the aerosol can, when the aerosol can is inserted into the connection unit. After the insertion of the aerosol can the clip may be pressed against the aerosol can with a clamping force corresponding to a spring force of the elastically bent away clip. A suitable press fit may be provided between the respective clip and the aerosol can. Aerosol cans are usually produced in line with a relevant standard, so that the outer diameter of the aerosol can of an intended type of aerosol can is known, so that the clips can be arranged inside the connection unit with respect to the known form of the aerosol can for providing a sufficient clamping force and sufficient friction force. Particularly a diameter of the head part of the aerosol can is smaller than a diameter of the body part of the aerosol can. The head part may pass the lower clip without being clamped until the head part reaches the upper clip and the body part reaches the lower clip. The insertion of the aerosol can can be facilitated. If so, the aerosol vent may be fixed to the head part via a metal valve cup, wherein the valve cup may comprise a circumferential groove due to a provided crimp connection. The upper clip may be inserted into this groove, so that a clip connection is provided with a releasable positive fit. If so, the clip may comprise a friction increasing element, for instance a rubber coating or the like, so that the clamping force provided by the clip may lead to a sufficient friction force.

The connection unit and particularly the whole actuation unit may be designed for covering a length 1 of the total length L of the aerosol can, wherein particularly $0.05 \leq 1/L \leq 0.75$, preferably $0.10 \leq 1/L \leq 0.50$ and particularly preferred $0.25 \leq 1/L \leq 0.33$ applies. Particularly the aerosol cans stay accessible from the bottom. This means that there is not bottom plate located below the aerosol cans connected to the connection unit for supporting the aerosol cans against a detaching from the connection unit. The Actuation unit may be designed bottom-free with respect to the inserted aerosol cans. Particularly the cover is only fixed to the connection unit, wherein the connection unit is only fixed to the cover and may be clamped only to the aerosol cans. Preferably the only connection of the cover is the connection to the connection unit. A container connected to the cover or to the connection unit can be omitted. The buttons may be loss-proof arranged between the cover and the connection unit. For example the buttons may comprise a protruding rim or other part limiting a position maximum far away from the respective aerosol can by abutting a part of the cover. If so, a spring may be provided between the button and the connection unit for moving the button automatically in the position maximum far away from the respective aerosol can, when no force is applied to the button from the operator. The cover and/or the buttons and/or the connection unit may be made from a plastic material, particularly a thermoplastic material. The first button and/or the second button may comprise an actuation face at its upper top front face, where a human finger can be placed for pushing the button downwards towards the aerosol can. Particularly the actuation face is mainly concave and may follow at least partially the form of the human finger. The first button and/or the second button may comprises a side face pointing mainly lateral to the actuation direction, wherein the side face may slide onto a corresponding face of the cover, so that the respective button is guided by the cover for being moveable mainly only along the actuation direction, particularly mainly in parallel to a longitudinal direction of the aerosol vent and/or the aerosol can.

Particularly the connection unit is adapted for clamping the first aerosol can and the second aerosol can by means of a clamping force providing a friction force against an axial displacement of the first aerosol can and a second aerosol can in the connection unit, which is higher than an actuation force for opening a first aerosol vent of the first aerosol can and a second aerosol vent of the second aerosol can. A suitable press fit may be provided between the respective clip and the aerosol can. Aerosol cans are usually produced in line with a relevant standard, so that the outer diameter of the aerosol can of an intended type of aerosol can is known, so that the clips can be arranged inside the connection unit with respect to the known form of the aerosol can for providing a sufficient clamping force and sufficient friction force. Particularly the friction force provided by the clips is low enough for detaching the aerosol can from the connection unit by hand.

Preferably the first button comprises a first inlet port for receiving a part of the first aerosol vent, particularly in a press-fitted manner, and for abutting a distal first front face of the first aerosol vent, wherein the first button comprises a first stop for limiting the maximum displacement of the first button from the upper most position towards the connection unit and/or the second button comprises a second inlet port for receiving a part of the second aerosol vent, particularly in a press-fitted manner, and for abutting a distal second front face of the second aerosol vent, wherein the second button comprises a second stop for limiting the maximum displacement of the second button from the most upper position towards the connection unit, wherein particularly the first inlet port and/or the second inlet port comprises a stepped channel. When the respective button is pressed downwards towards the aerosol vent the inlet port may abut a front face of the stem of the aerosol vent and/or may frictionally engage the stem for pushing down the stem and opening the aerosol vent. The button may comprise a discharge channel communicating with the aerosol vent so that the content of the aerosol can may be discharged via the discharge channel of the button. The stem of the aerosol vent may be a tube with a side opening which is closed in the upper position and opened in the lower position. The stem may be moved automatically in the upper closed position by means of the inside pressure of the aerosol can and/or by means of a spring pre-loading the stem. Due to the stop of the respective button the lowest position of the button can be defined. When a too high force is applied to the button, a part of the force may be supported by the connection unit via the stop so that the effective actuation force applied to the aerosol vent is limited to an amount that the aerosol can cannot detached from the connection unit accidentally. The maximum axial distance of the stop with respect to the connection unit may be chosen such, that in the lowest position of the button the maximum inserted position of the stem inside the aerosol vent is just or nearly reached. The maximum axial distance of the stop with respect to the connection unit allows to open the aerosol vent but prevents a pushing the aerosol can out of the connection unit. Further, in the case that the stem of the aerosol vent is press-fitted received in the button, particularly in the inlet port, the stop forces a detaching of the aerosol vent from the button. The stop prevents that the button is pulled off the actuation unit by means of the detached aerosol can or loses its guiding to the cover. Particularly the inlet port comprises a stepped channel in axial direction. The inlet port may comprise a lower part with a larger inner diameter providing a rough centering of the stem of the aerosol vent inside the inlet port. An upper part of the inlet port may comprise a smaller inner diameter for receiving the stem in a press-fitted manner. Particularly the upper part of the inlet port is arranged above the distal front face of the stem when the button is not pressed downwards and/or positioned in its upper most position. Since the stem cannot meet the upper part of the inlet port, while the aerosol can is inserted into the actuation unit, an unintentional discharging of the aerosol can is prevented. When the corresponding button is pressed the first time intentionally, a press-fit between the stem of the aerosol vent and the upper part of the inlet port may be provided. This may inter alia prevent a rattling of the button inside the cover and enables a short actuation displacement of the button for opening the aerosol vent. Particularly the inlet port, preferably the lower part of the inlet port is guided by and/or centered in the connection unit. An insertion of the stem of the aerosol vent into the inlet port can be facilitated and a quite small extension in axial direction is enabled facilitating the holding of the actuation unit by one hand of the operator.

Particularly preferred the connection unit comprises a plate for limiting the insertion of the first aerosol can and the second aerosol can into the connection unit, wherein the plate comprises a first opening for leading the first aerosol vent to the first button and a second opening for leading the second aerosol vent to the second button. The head part of the aerosol can may abut the plate so that the maximum inserted position is defined by the plate. The aerosol vent or at least a part of a stem of the aerosol vent may be put at least partially through the opening for reaching the respective button. Due to the defined relative position of the aerosol can inside the connection unit the relative position of the aerosol vent to the respective button is also defined. Particularly a stem of the aerosol vent may be already slightly inserted into the corresponding inlet port of the button, when the head part of the aerosol can meets the plate. Then, only a small displacement of the button is sufficient to open the aerosol vent, which facilitates the handling for the operator. At the same time it is safeguarded that the stem of the aerosol vent is not pressed downwards while the aerosol can is inserted into the connection unit. Particularly the upper clip and the lower clip provides an at least rough centering of the aerosol can, so that the stem of the aerosol vent does not meet the plate or is pressed against the respective bottom during the insertion of the aerosol can into the connection unit.

In a preferred embodiment, the plate comprises a first collar surrounding the first opening for receiving the first inlet port, particularly with a clearance, and for abutting the first stop and/or a second collar surrounding the second opening for receiving the second inlet port, particularly with a clearance, and for abutting the second stop. The collar may provide a rough centering of the inlet port inside the collar. This provides an additional guiding of the button spaced to the cover and the other button so that a tilting of the button may be prevented or at least reduced. In addition the collar may meet the stop of the button in the lowest position of the button. The movability of the button in axial direction may be defined by the maximum distance between the stop of the button and the collar of the connection unit. Particularly the inlet port, preferably the lower part of the inlet port is guided by and/or centered in the collar. Preferably the lower end of the inlet port is arranged below the level of the upper end of the protruding collar at any position of the respective button between the upper most position and the lowest position.

Particularly the first button comprises a first discharge channel for communicating with the first aerosol vent and a first outlet orifice pointing mainly in radial direction, wherein the cover comprises a first outlet opening for communicating with the first outlet orifice in any position of the first button between the most upper position and the lowest position of the first button and/or the second button comprises a second discharge channel for communicating with the second aerosol vent and a second outlet orifice pointing mainly in radial direction, wherein the cover comprises a second outlet opening for communicating with the second outlet orifice in any position of the second button between the most upper position and the lowest position of the second button. The content of the aerosol can may escape the aerosol can in axial direction but escapes the actuation unit in mainly radial direction. The content may be applied in a direction mainly lateral to the longitudinal direction of the aerosol can. This corresponds to the usual handling of aerosol cans for applying cosmetic products, like haircare products. Particularly the outlet orifices point such that the discharged content via the first discharge channel and the second discharge channel overlap in a region, particularly ca. 10 cm away from the outlet orifices. Since the outlet orifice is part of the movable button the extension of outlet opening of the cover is large enough that the content escaping the outlet orifice can pass the cover. Particularly a mechanical break element is provided in the discharge channel, preferably forming the outlet orifice. The mechanical break element may spray the discharged content of the aerosol can.

Preferably a contact of the first upper clip with the first aerosol can is spaced to a contact of the first lower clip by a distance d and/or a contact of the second upper clip with the second aerosol can is spaced to a contact of the second lower clip by a distance d, wherein 5 mm≤d≤50 mm, particularly 15 mm≤d≤30 mm and preferably d=20 mm±2 mm applies. This distance provides a sufficient centering of the aerosol can when the aerosol can is inserted into the connection unit. Further the distance is sufficient for preventing a tilting of the aerosol can inside the connection unit, while a significant part of the aerosol can may protrude from the connection unit so that information printed on the aerosol can about the content of the aerosol can is sufficiently readable.

Particularly preferred the first button comprises a first upper sliding face for sliding on a corresponding second upper sliding face of the second button and a first lower sliding face for sliding on a corresponding second lower sliding face of the second button, wherein the first upper sliding face is arranged mainly at the upper end of the first button and the second upper sliding face is arranged mainly at the upper end of the second button, wherein the first lower sliding face is arranged mainly at the lower end of the first button, particularly mainly on a level of the first inlet port, and the second lower sliding face is arranged mainly at the lower end of the second button, particularly mainly on a level of the second inlet port. The upper sliding face and the lower sliding face may be spaced by a gap, so that the contact area between the first button and the second button is low for preventing unnecessary friction. The extension of the sliding faces are particularly chosen such, that in the most upper position of the one button and the lowest position of the other button still a contact of the opposing sliding faces is present. Since the upper sliding face and the lower sliding face may be spaced to each other a guiding of the buttons may be given and a tilting of the buttons may be prevented.

Particularly the first button comprises a distal first actuation face for pressing the first button by means of a human finger, wherein the first actuating face comprises a first haptic element, particularly a rib, for indicating a first rim of the first bottom pointing towards the second button, and/or the second button comprises a distal second actuation face for pressing the second button by means of a human finger, wherein the second actuating face comprises a second haptic element, particularly a rib, for indicating a second rim of the second bottom pointing towards the first button. Due to the haptic element the operator may feel where the one button ends and the other button begins. The operator can easily feel which button or buttons he would press without the need of looking at the buttons. The handling of the actuation unit is increased and less time-consuming. Particularly the actuation face provides a concave curvature for receiving the human finger so that the human finger may intuitively rest on or in the actuation face in a suitable position of pushing only this button downwards.

Preferably the first haptic element and the second haptic element are spaced to each other and border a receiving space for receiving a human finger between the first haptic element and the second haptic element. Particularly a part of the first button and a part of the second button borders a deepening which rims are given by the haptic elements designed as ribs. The receiving space may be designed correspondingly to the human finger. When the operator intends to push the first button and the second button simultaneously, the receiving space bordered by the first button and the second button by help of its haptic elements defines a volume into which the operator would intuitively place its finger. Particularly the bordered receiving space is designed such that the force applied from the human finger is divided mainly equally to the first button and the second button. The actuation of two or more buttons at the same time may be facilitated.

Preferably the connection unit comprises a protruding connection wall extensively connected to the cover, wherein particularly the connection wall is mainly flush with an outer face of the first lower clip and the second lower clip. The connection unit may be designed mainly H-like in a cross sectional view. The connection wall may protrude from a plate arranged mainly lateral to the longitudinal direction of the aerosol cans upwards, so that the cover may be inserted into the space bordered by the connection wall. A mainly circumferential wall of the cover may extensively contacts the connection wall of the connection unit. If so, a press fit may be provided between the connection wall and the cover. Further it is possible to fix the cover to the connection wall via an adhesive film, ultrasonic welding or the like. Particularly the connection wall may be elongated downwards below the level of the plate for forming the lower clip. Preferably the outer face of the connection unit may be designed mainly stepless so that the holding of the actuation unit by means of a hand of the operator may be facilitated.

Particularly preferred the first upper clip and the first lower clip are arranged mainly coaxially to each other and/or the second upper clip and the second lower clip are arranged mainly coaxially to each other. Due to the mainly coaxial arrangement the upper clip and the lower clip may provide an at least rough centering of the aerosol can, so that the stem of the aerosol vent does not meet a part of the connection unit or is pressed against the respective bottom during the insertion of the aerosol can into the connection unit. An unintentionally discharge of the content of the aerosol can while the aerosol can is inserted into the connection unit may be prevented.

Particularly the cover comprises at its distal end a deepening, wherein the first button and the second button are received in a central opening of the deepening. When different actuation units are place one above the other, the buttons are secured for being unintentionally pressed by the upper actuation unit or other device. An unintentional actuation may be prevented. Further the deepening provides a slope which directs a human finger towards the buttons. The handling and actuation of the actuation unit without looking at the actuation unit is facilitated.

In a further embodiment a first actuation plate for actuating the first button and/or a second actuation plate for actuating the second button is pivotable connected with the cover. Particularly the first button and/or the second button comprises at its distal end an rounded actuation face. When the actuation plate is pivoted by means of a force applied of the operator the respective button may be pressed downwards for opening the respective aerosol vent. In this case a haptic element may be provided at the actuation plate but not necessarily at the button itself.

A further aspect of the invention is directed to an aerosol spray system comprising an actuation unit, which may be designed as previously described, a first aerosol can inserted into the actuation unit and a second aerosol can inserted into the actuation unit, wherein the first aerosol can and the second aerosol can are clamped in the actuation unit by means of a clamping force providing a friction force against an axial displacement of the first aerosol can and a second aerosol can in the actuation unit, which is higher than an actuation force for opening a first aerosol vent of the first aerosol can and a second aerosol vent of the second aerosol can. Due to the guidance of the buttons the upper clip and the lower clip are sufficient for preventing a tilting and detaching of the protruding aerosol cans, so that a facilitated application of a plurality of aerosols at the same time and individually, particularly for applying cosmetic products like haircare products, is enabled.

A further aspect of the invention is directed to an use of an actuation unit, which may be designed as previously described, for clamping a first aerosol can and a second aerosol can by means of a clamping force providing a friction force against an axial displacement of the first aerosol can and the second aerosol can in the actuation unit, which is higher than an actuation force for opening a first aerosol vent of the first aerosol can and a second aerosol vent of the second aerosol can. Due to the guidance of the buttons the upper clip and the lower clip are sufficient for preventing a tilting and detaching of the protruding aerosol cans, so that a facilitated application of a plurality of aerosols at the same time and individually, particularly for applying cosmetic products like haircare products, is enabled.

BRIEF DESCRIPTION OF THE DRAWINGS

These and other aspects of the invention will be apparent from and elucidated with reference to the embodiments described hereinafter, wherein the described features can constitute each solely or in combination an independent aspect of the invention. In the drawings.

DETAILED DESCRIPTION OF THE INVENTION

Figure 1:
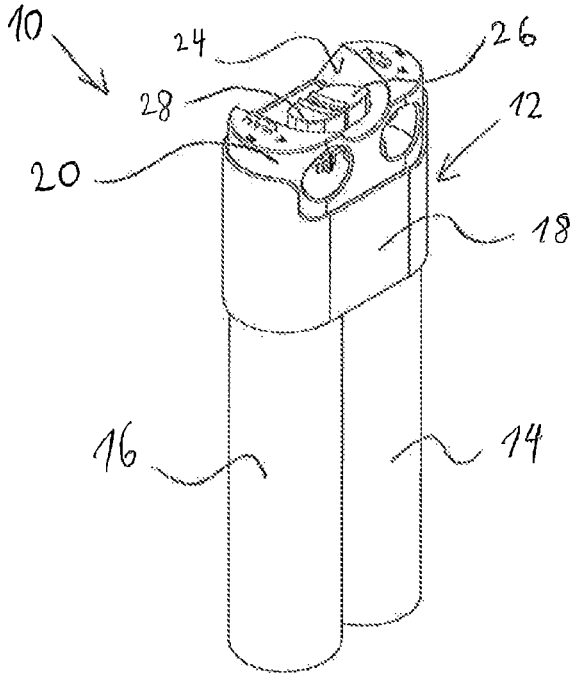
FIG. 1: is a perspective view of an aerosol spray system.
Figure 2:
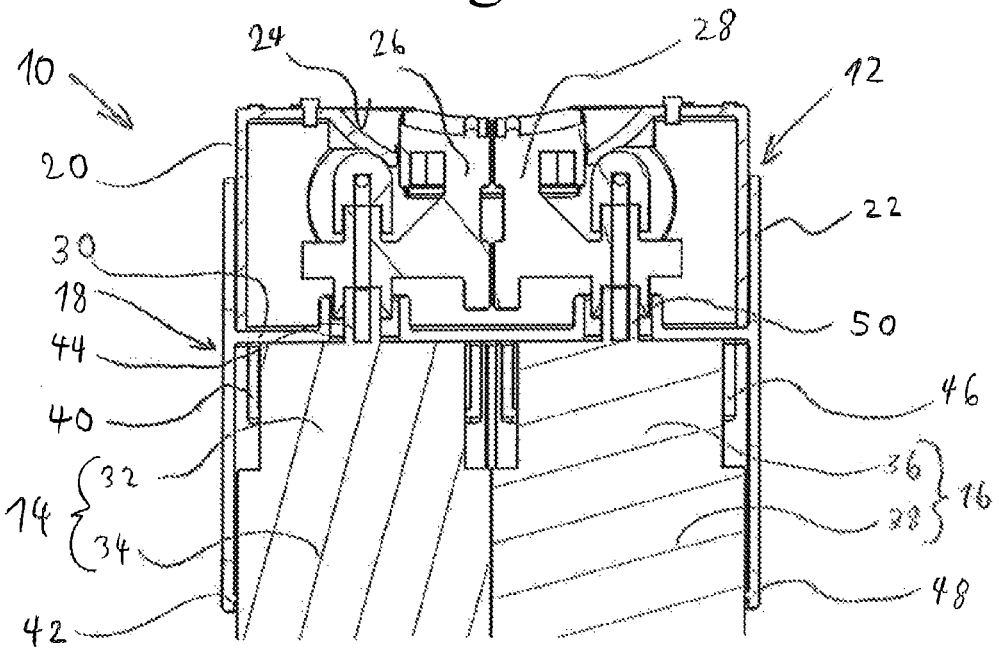
FIG. 2: is a cross sectional view of the aerosol spray system of FIG. 1, FIG. 3: is a cross sectional view of an actuation unit of the aerosol spray system of FIG. 1, FIG. 4: is a perspective view of a button of the actuation unit of FIG. 3 and FIG. 5: is a detailed front view of the actuation unit of FIG. 3.

The aerosol spray system 10 illustrated in FIG. 1 consists of an actuation unit 12 and a plurality of aerosol cans, particularly a first aerosol can 14 and a second aerosol can 16. Further parts for actuating the aerosol cans 14, 16 are not necessary and omitted. As illustrated in FIG. 2 the actuation unit 12 comprises a connection unit 18, into which the aerosol cans 14, 16 are clamped. A cover 20 is fixed to a connection wall 22 of the connection unit 18. The cover 20 comprises at its distal end pointing away from the aerosol cans 14, 16 a deepening 24, where at a central opening at its bottom a first button 26 for actuating the first aerosol can 14 and a second button 28 for actuating the second aerosol can 16 are received. The first button 26 and the second button 28 are guided by the cover 20 and particularly by the respective other button 28, 26 in axial direction mainly in parallel to the longitudinal direction of the aerosol cans 14, 16.

Figure 3:
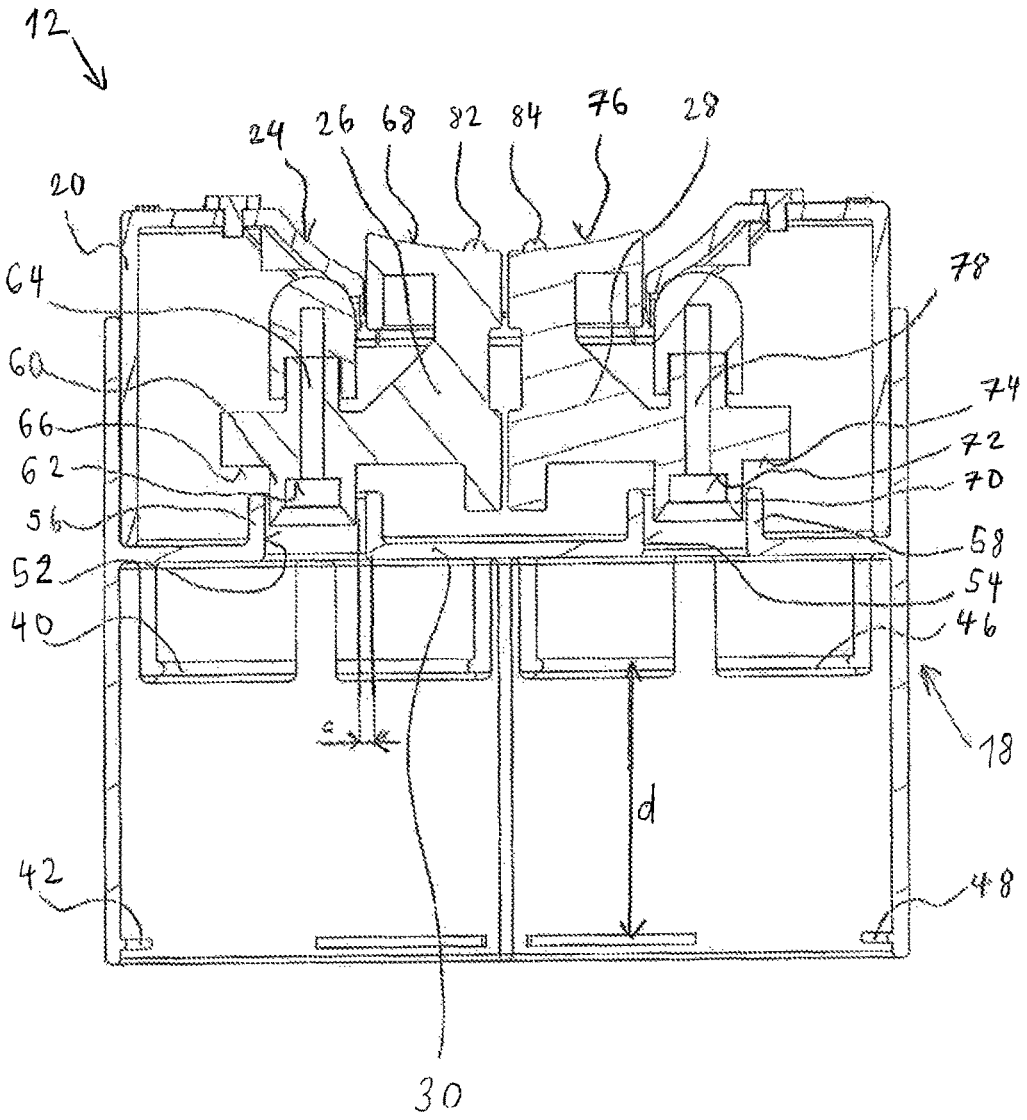

As illustrated in FIG. 3 the connection unit 18 comprises a plate 30 from which the connection wall 22 protrudes upwards. The first aerosol can 14 comprises an upper first head part 32 connected to a lower first body part 34, which diameter may be larger than the diameter of the first head part 32. The second aerosol can 16 comprises an upper second head part 36 connected to a lower second body part 38, which diameter may be larger than the diameter of the second head part 36. Particularly the design of the first aerosol can 14 and of the second aerosol can are in line with an applicable industrial standard. When the first aerosol can 14 is inserted into the connection unit 18 a first head part 32 may meet the plate 30 so that the maximum inserted position is limited by means of the plate 30. Correspondingly, when the second aerosol can 16 is inserted into the connection unit 18 a second head part 36 may meet the plate 30 so that the maximum inserted position is limited by means of the plate 30. In addition the connection unit 18 comprises a first upper clip 40 for clamping the first head part 32 and a first lower clip 42 for clamping the first body part 34. By means of the first upper clip 40 and the first lower clip 42 the first aerosol can 14 is clamped into the connection unit 18 with a sufficient friction force that the first aerosol can 14 is not pressed out of the connection unit, when a first aerosol valve 44 is actuated by means of the first button 26. Further the connection unit 18 comprises a second upper clip 46 for clamping the second head part 36 and a second lower clip 48 for clamping the second body part 38. By means of the second upper clip 46 and the second lower clip 48 the second aerosol can 16 is clamped into the connection unit 18 with a sufficient friction force that the second aerosol can 16 is not pressed out of the connection unit, when a second aerosol valve 50 is actuated by means of the second button 28. The first upper clip 40 and the first lower clip 42 on the one hand and the second upper clip 46 and the second lower clip 48 on the other hand are arranged coaxially to each other so that the respective aerosol can 14, 16 can be centered with respect to the assigned upper clip 40, 46 and lower clip 42, 48. A contact area of the upper clip 40, 46 is spaced to a contact area of the lower clip 42, 48 by a distance d of ca. 15 mm so that a good centering is provided and a tilting of the aerosol can 14, 16 inside the connection unit 18 is prevented. The upper clip 40, 46 and the lower clip 42, 48 protrude from the plate 30 downwards, wherein the outer face of the lower clips 42, 48 are mainly flush with the outer face of the connection wall 22.

The plate 30 comprises a first opening 52 for leading the first aerosol valve 44 through the plate 30, so that the first aerosol valve 44 may reach the first button 26. In addition the plate 30 comprises a second opening 54 for leading the second aerosol valve 50 through the plate 30, so that the second aerosol valve 50 may reach the second button 28. The first opening 52 is surrounded by a first collar 56 and the second opening 54 is surrounded by a second collar 58, wherein the collars 56, 58 protrude upwards from the plate 30. A stem of the first aerosol vent 44 may reach through the first opening 52 and may be inserted or even slightly pressed into a first inlet port 60 of the first button 26. The stem of the first aerosol vent 44 may abut a first abutting face 62 of the first inlet port 60 when the first button 26 is pressed downwards by the operator. The first abutting face 62 may press the stem of the first aerosol vent 44 downwards by means of the applied actuation force for opening the first aerosol vent 44. The first button 26 comprises a first discharge channel 64 communicating with the opened first aerosol valve 44 and guiding the content of the first aerosol can 14 to a first outlet orifice 65 of the first button 26. The first inlet port 60 reaches partially into the first collar 56, even when the first button 26 is positioned in its upper most position. A significant clearance c is provided between the first inlet port 60 and the first collar 56. The first button 24 comprises a first stop 66 which meets the first collar 56 in the lowest position of the first button 24. The stop 66 may be provided by a part of the first button 24 protruding in a direction lateral to the longitudinal direction of the first collar 56. Preferably the stop 66 is provided by a first connection arm 67 bridging a lateral displacement of a first actuation face 68 of the first button 24 for receiving a human finger and the first inlet port 60. The second button 26 may be designed correspondingly to the first button 24. Particularly the first button 24 and the second button 26 may be designed identically but arranged mirror-inverted with respect to each other. This means that also the second button 26 may comprise a second inlet port 70 with a second abutting face 72 for abutting a stem of the second aerosol vent 50. The second button 26 may comprise a second stop 74 provided by a lateral protruding second connection arm 75 of the second button 28 connecting a second actuation face 76 with the second inlet port 70 for limiting the lowest position of the second button 28 by meeting the second collar 58. A second discharge channel 78 starts at the level of the second abutting face 72 for leading the content of the second aerosol can 16 to a second outlet orifice 80. Particularly a first spring supported by the plate 30 and the first button 26, particularly the first connection arm 67, and/or a second spring supported by the plate 30 and the second button 28, particularly the second connection arm 75, is provided for automatically moving the respective button 26, 28 in its upper most position, when no actuation force is applied. Preferably the upper most position of the button 26, 28 is limited by the button 26, 28 meeting a part of the cover 20.

Figure 4:
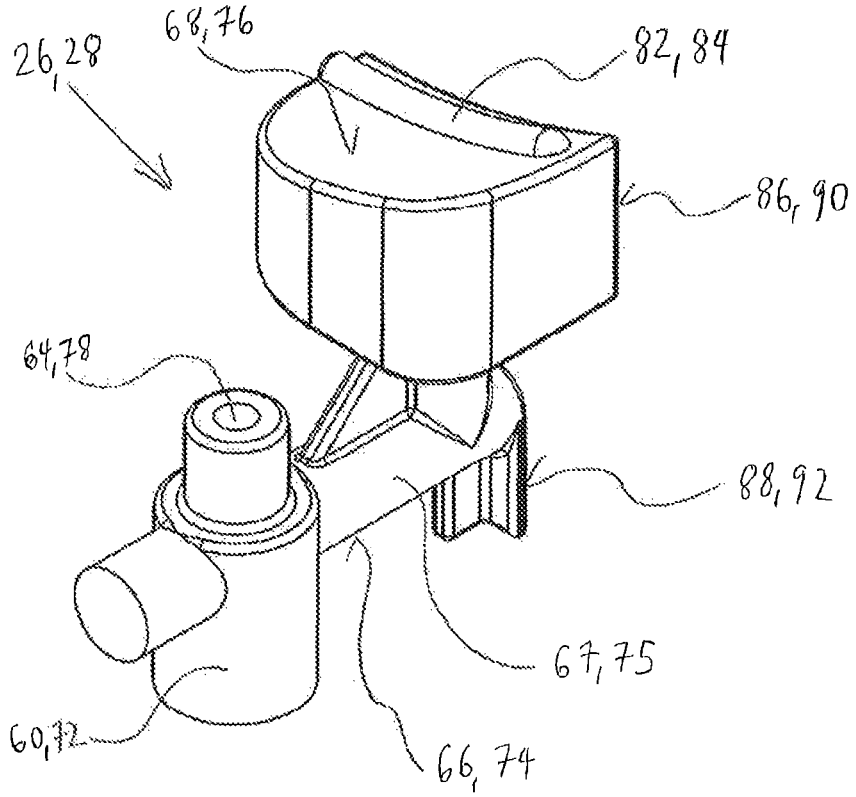

As illustrated in FIG. 4 the respective button 26, 28 may comprises a first haptic element 82 arranged in the first actuation face 68 and/or a second haptic element 84 arranged in the second actuation face 76. The haptic element 82, 84 is provided by a protruding rib arranged close to a rim of the button 26, 28 pointing to the other button 28, 26. The operator may feel by means of the haptic element 82, 84 whether his finger would still press only one of the buttons 26, 28 or the first button 26 and the second button 28 altogether. In addition, the first button 26 comprises a first upper sliding face 86 and a first lower sliding face 88 spaced to the first upper sliding face. The second button 28 comprises a second upper sliding face 90 and a second lower sliding face 92 spaced to the first upper sliding face. The upper sliding faces 86, 90 may contact each other, while the lower sliding faces 88, 92 contact each other so that the buttons 26, 28 are guided at each other and a tilting is prevented. Particularly the lower end of the lower sliding faces 88, 92 is mainly on the same level as the lower end of the assigned inlet port 60, 72.

Figure 5:
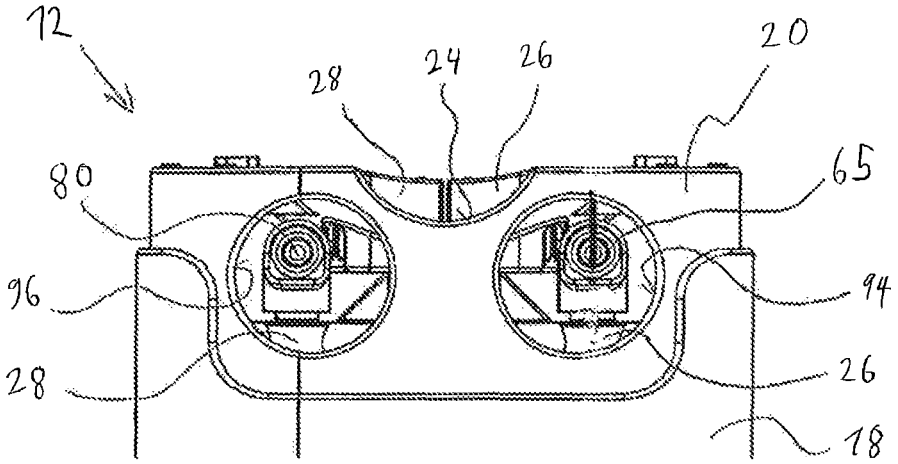

As illustrated in FIG. 5 the cover 20 comprises a first outlet opening 94 for discharging the content of the first aerosol can 14 through the cover 20. Correspondingly the cover 20 comprises a second outlet opening 96 for discharging the content of the second aerosol 16 can through the cover 20. The extension of the outlet openings 96, 98 is sufficient, that in any position of the respective button 26, 28 the content can be sprayed through the cover. Particularly the first outlet orifice 65 comprises a first mechanical break element for providing a spray of the discharged content. The second outlet orifice 80 may comprise a second mechanical break element for providing a spray of the discharged content.

What is claimed is:

1. An actuation unit for a plurality of aerosol cans, comprising a cover, a first button having an upper part located opposite with respect to a lower part of the first button and configured for pushing a first aerosol vent of a first aerosol can, wherein the upper part of the first button has a first side face slidable onto a first corresponding face of the cover such that the first button is partially guided by the cover, a second button having an upper part located opposite with respect to a lower part of the second button and configured for pushing a second aerosol vent of a second aerosol can, wherein the upper part of the second button has a second side face slidable onto a second corresponding face of the cover such that the second button is partially guided by the cover, wherein the first and second buttons are arranged adjacent to each other and partially guided by each other, and a connection unit, configured for clamping the first aerosol can and the second aerosol can, connected to the cover, wherein the connection unit comprises a first upper clip configured for clamping a head part of the first aerosol can, a second upper clip configured for clamping a head part of the second aerosol can, a first lower clip configured for clamping a body part of the first aerosol can and a second lower clip configured for clamping a body part of the second aerosol can, and further wherein the connection unit is adapted for covering only an upper part of the first aerosol can and the second aerosol can, the lower part of the first button is disposed within a first opening of the connection unit that is formed within a first collar of the connection unit, and the lower part of the second button is disposed within a second opening of the connection unit that is formed within a second collar of the connection unit.

2. The actuation unit according to claim 1 wherein the connection unit is adapted for clamping the first aerosol can and the second aerosol can by a clamping force providing a friction force against an axial displacement of a first aerosol can and a second aerosol can in the connection unit, wherein the clamping force is higher than an actuation force for opening a first aerosol vent of the first aerosol can and a second aerosol vent of a second aerosol can.

3. The actuation unit according to claim 1 wherein the first button comprises a first inlet port configured for receiving a part of the first aerosol vent, in a press-fitted manner, and for abutting a distal first front face of the first aerosol vent, wherein the first button comprises a first stop configured for limiting the maximum displacement of the first button from the upper most position towards the connection unit and the second button comprises a second inlet port configured for receiving a part of the second aerosol vent, in a press-fitted manner, and for abutting a distal second front face of the second aerosol vent, wherein the second button comprises a second stop configured for limiting the maximum displacement of the second button from the most upper position towards the connection unit, wherein the first inlet port and/or the second inlet port comprises a stepped channel.

4. The actuation unit according to claim 1 wherein the connection unit comprises a plate configured for limiting the insertion of the first aerosol can and the second aerosol can into the connection unit, wherein the plate comprises a first opening configured for leading the first aerosol vent to the first button and a second opening configured for leading the second aerosol vent to the second button.

5. The actuation unit according to claim 4 wherein the plate comprises a first collar surrounding the first opening configured for receiving the first inlet port, with a clearance, and for abutting the first stop and/or a second collar surrounding the second opening for receiving the second inlet port, with a clearance, and for abutting the second stop.

6. The actuation unit according to claim 1 wherein the first button comprises a first discharge channel configured for communicating with the first aerosol vent and a first outlet orifice pointing mainly in radial direction, wherein the cover comprises a first outlet opening configured for communicating with the first outlet orifice in any position of the first button between the most upper position and the lowest position of the first button and/or the second button comprises a second discharge channel configured for communicating with the second aerosol vent and a second outlet orifice pointing mainly in radial direction, wherein the cover comprises a second outlet opening configured for communicating with the second outlet orifice in any position of the second button between the most upper position and the lowest position of the second button.

7. The actuation unit according to claim 1 wherein a contact of the first upper clip with the first aerosol can is spaced to a contact of the first lower clip by a distance d and/or a contact of the second upper clip with the second aerosol can is spaced to a contact of the second lower clip by the distance d, wherein 5 mm≤d≤50 mm applies.

8. The actuation unit according to claim 1 wherein the first button comprises a first upper sliding face configured for sliding on a corresponding second upper sliding face of the second button and a first lower sliding face configured for sliding on a corresponding second lower sliding face of the second button, wherein the first upper sliding face is arranged mainly at the upper end of the first button and the second upper sliding face is arranged mainly at the upper end of the second button, wherein the first lower sliding face is arranged at the lower end of the first button, adjacent to the first inlet port, and the second lower sliding face is arranged at the lower end of the second button, adjacent to the second inlet port.

9. The actuation unit according to claim 1 wherein the first button comprises a distal first actuation face configured for pressing the first button by means of a human finger, wherein the first actuating face comprises a first haptic element configured for indicating a first rim of the first bottom pointing towards the second button, and the second button comprises a distal second actuation face configured for pressing the second button by means of a human finger, wherein the second actuating face comprises a second haptic element configured for indicating a second rim of the second bottom pointing towards the first button.

10. The actuation unit according to claim 9 wherein the first second haptic elements are spaced with respect to each other and border a receiving space sized and/or configured for receiving a human finger between the first haptic element and the second haptic element.

11. The actuation unit according to claim 1 wherein the connection unit comprises a protruding connection wall extensively connected to the cover, wherein the connection wall is mainly flush with an outer face of the first lower clip and the second lower clip.

12. The actuation unit according to claim 1 wherein the first upper clip and the first lower clip are arranged mainly coaxially to each other and/or the second upper clip and the second lower clip are arranged mainly coaxially to each other.

13. The actuation unit according to claim 1 wherein the cover comprises at its distal end a deepening, wherein the first button and the second button are received in a central opening of the deepening.

14. An aerosol spray system comprising the actuation unit according to claim 1, a first aerosol can inserted into the actuation unit and a second aerosol can inserted into the actuation unit, wherein the first and second aerosol cans are clamped in the actuation unit by a camping force providing a friction force against an axial displacement of the first and second aerosol cans in the actuation unit, wherein the clamping force is higher than an actuation force for opening a first aerosol vent of the first aerosol can and a second aerosol vent of the second aerosol can.

15. An actuation unit for a plurality of aerosol cans, comprising a cover, a first button for pushing a first aerosol vent of a first aerosol can, wherein the first button is partially guided by the cover, a second button for pushing a second aerosol vent of a second aerosol can, wherein the second button is partially guided by the cover, wherein the first button and the second button are arranged adjacent to each other and partially guided by each other, and a connection unit, for clamping the first aerosol can and the second aerosol can, connected to the cover, wherein the connection unit comprises a first upper clip for clamping a head part of the first aerosol can, a second upper clip for clamping a head part of the second aerosol can, a first lower clip for camping a body part of the first aerosol can and a second lower clip for clamping a body part of the second aerosol can, wherein the connection unit is adapted for covering only an upper part of the first aerosol can and the second aerosol can, wherein the first button comprises a distal first actuation face for pressing the first button by means of a human finger, wherein the first actuating face comprises a first haptic element and the second button comprises a distal second actuation face for pressing the second button by means of a human finger, wherein the second actuating face comprises a second haptic element, wherein the first haptic element and the second haptic element are spaced to each other and border a receiving space sized for receiving a human finger between the first haptic element and the second haptic element, wherein the receiving space bordered by the first and second haptic elements defines a volume positioned between the first and second buttons and configured such that a force applied thereto is divided to the first and second buttons.

16. The actuation unit according to claim 15, wherein the volume of the receiving space bordered by the first and second haptic elements is configured such that application of the force to the receiving space is substantially equally divided to the first and second buttons facilitating activation of the first and second buttons at the same time.

* * * * *